US009057526B2

(12) United States Patent
Barritt

(10) Patent No.: US 9,057,526 B2
(45) Date of Patent: Jun. 16, 2015

(54) PROGRAMMABLE COOKING APPLIANCE

(75) Inventor: William D. Barritt, Cleveland, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1359 days.

(21) Appl. No.: 10/952,716

(22) Filed: Sep. 30, 2004

(65) Prior Publication Data

US 2006/0065263 A1 Mar. 30, 2006

(51) Int. Cl.
*F24C 3/00* (2006.01)
*F24C 7/08* (2006.01)

(52) U.S. Cl.
CPC ..... *F24C 7/082* (2013.01)

(58) Field of Classification Search
USPC .. 126/19 R, 273 R, 39 G, 39 C, 39 BA, 41 R; 236/15 A; 200/39 A
See application file for complete search history.

(56) References Cited

U.S. PATENT DOCUMENTS 1,690,898 A * 11/1928 Hart ..... 219/492
1,745,420 A * 2/1930 Hewitt ..... 219/491
2,217,226 A * 10/1940 Lux ..... 200/39 A
2,471,862 A * 5/1949 Candor ..... 236/46 R
2,483,526 A * 10/1949 Candor ..... 219/489
3,364,338 A * 1/1968 Holtkamp ..... 219/398
3,688,978 A * 9/1972 Goodhouse et al. ..... 235/61 A
3,699,307 A * 10/1972 Malkin ..... 219/492
3,743,179 A * 7/1973 Grayson ..... 236/15 A
3,754,704 A * 8/1973 Grayson ..... 236/15 A
3,827,345 A * 8/1974 Willson ..... 99/325
3,837,568 A * 9/1974 Goodhouse et al. ..... 219/492
4,341,197 A * 7/1982 Butts ..... 126/39 BA
4,345,145 A * 8/1982 Norwood ..... 219/492
4,447,692 A * 5/1984 Mierzwinski ..... 219/720
4,467,184 A 8/1984 Loessel
4,517,431 A * 5/1985 Ueda ..... 219/719
4,601,004 A * 7/1986 Holt et al. ..... 700/300
4,602,147 A * 7/1986 Gell ..... 219/509
4,675,541 A * 6/1987 Peters et al. ..... 307/117
4,814,588 A * 3/1989 Hotta et al. ..... 219/714
5,148,737 A * 9/1992 Poulson ..... 99/327

(Continued)

FOREIGN PATENT DOCUMENTS

CA 1006896 * 3/1977
CA 2 301 463 * 10/2000

(Continued)

OTHER PUBLICATIONS

"JENN-AIR" (Use and Care Manual, Grill-Range with Self-Cleaning Conventional and Convection Oven, Models SVE47500 and SVE47600; pp. 1-3,8,18-20,23-25,34,36-39), no date.*

*Primary Examiner* — Avinash Savani
*Assistant Examiner* — Vivek Shirsat

(57) ABSTRACT

A control system for a cooking appliance can operate in first or second modes of operation. In the first mode, a consumer is required to input both a temperature parameter and a time parameter before initiating a cooking operation. Once the cooking operation has completed, the control system operates the cooking appliance in a low temperature mode for a predetermined period. In this manner, a cooked food item is maintained at a reduced temperature so that the food item does not burn. In the second mode, the consumer can choose to bypass the required time input parameter so as to operate the cooking appliance based solely on the temperature parameter.

8 Claims, 4 Drawing Sheets

(56) References Cited

U.S. PATENT DOCUMENTS

| | | | | | |
|---|---|---|---|---|---|
| 5,339,726 | A * | 8/1994 | Poulson | 99/327 |
| 5,786,568 | A * | 7/1998 | McKinney | 219/400 |
| 5,938,966 | A * | 8/1999 | Oh et al. | 219/702 |
| 5,981,915 | A | 11/1999 | Head | |
| 6,005,229 | A * | 12/1999 | Brown et al. | 219/483 |
| 6,080,972 | A * | 6/2000 | May | 219/494 |
| 6,097,016 | A * | 8/2000 | Hirata et al. | 219/720 |
| 6,101,930 | A * | 8/2000 | Van Over | 99/426 |
| 6,114,663 | A * | 9/2000 | Stockley | 219/398 |
| 6,121,593 | A * | 9/2000 | Mansbery et al. | 219/679 |
| 6,140,619 | A | 10/2000 | Couch | |
| 6,140,621 | A | 10/2000 | Ho et al. | |
| 6,355,914 | B1 * | 3/2002 | Stockley | 219/482 |
| 6,425,319 | B1 * | 7/2002 | Wu | 99/332 |
| 6,486,453 | B1 * | 11/2002 | Bales et al. | 219/702 |
| 6,552,309 | B1 * | 4/2003 | Kish et al. | 219/506 |
| 6,666,676 | B2 * | 12/2003 | Rodriguez-Rodriguez et al. | 431/67 |
| 2003/0001902 | A1 * | 1/2003 | Choi et al. | 345/810 |
| 2003/0070799 | A1 * | 4/2003 | Mueller et al. | 165/254 |

FOREIGN PATENT DOCUMENTS

| | | | | |
|---|---|---|---|---|
| DE | 102 03 614 | * | 7/2003 | |
| EP | 0 608 147 | * | 7/1994 | |
| EP | 0 727 919 | * | 8/1996 | |
| GB | 2076181 | * | 1/1981 | |
| JP | 55053640 A | * | 4/1980 | F24C 1/02 |
| JP | 58-18030 | * | 2/1983 | |
| JP | 62-217021 | * | 9/1987 | |
| JP | 04302948 A | * | 10/1992 | F24H 3/02 |

* cited by examiner

SELECT TEMP
350°
12:00
TIMER1 On/Off
TIMER2 On/Off
UPPER OVEN
CANCEL
Convect Bake
Clean
Broil
More Options
Oven Light
LOWER OVEN
Help
Favorites
Setup
MODE SELECT
Back
Enter
BAKE ELEMENT
BROIL ELEMENT
FAN
CONVECT HEATING ELEMENT
BUZZER
MEMORY
CPU
TEMP SENSORS
FAN SPEED SENSOR
DOOR SENSOR SET COOK TIME
350°
0:45
START
TIMER1 On/Off
TIMER2 On/Off
UPPER OVEN
Bake
Broil
Convect
Clean
CANCEL
More Options
Oven Light
LOWER OVEN
Help
Favorites
Setup
MODE SELECT
Back
Space
Enter
BAKE ELEMENT
BROIL ELEMENT
FAN
CONVECT HEATING ELEMENT
BUZZER
MEMORY
CPU
TEMP SENSORS
FAN SPEED SENSOR
DOOR SENSOR SELECT TEMP
350°
START
12:00
TIMER2 On/Off
TIMER1 On/Off
Help
Favorites
Setup
MODE SELECT
Back
Space
Enter
UPPER OVEN
Convect Bake
Clean
Broil
CANCEL
More Options
Oven Light
LOWER OVEN
BAKE ELEMENT
BROIL ELEMENT
FAN
CONVECT HEATING ELEMENT
BUZZER
MEMORY
CPU
TEMP SENSORS
FAN SPEED SENSOR
DOOR SENSOR

PROGRAMMABLE COOKING APPLIANCE

BACKGROUND OF THE INVENTION

1. Field of the Invention

The present invention pertains to the art of cooking appliances and, more particularly, to a control system for a cooking appliance that requires both time and temperature input parameters before initiating a cooking operation.

2. Discussion of the Prior Art

Most modern cooking appliances enable a consumer to input time and temperature parameters for a cooking operation. While temperature is generally a required input parameter, inputting a time parameter is sometimes optional. If the consumer wishes to set cooking time, cooking appliances typically include a clock or timer mechanism that permits such programming. Setting a cook time is a beneficial feature for an oven. Once a time is set, the consumer can walk away and not worry that the food item will burn. Unfortunately, experience has shown that setting the cook time is a seldom used feature.

Often times, the consumer will place a food item into the oven, set a temperature and lose track of time. The food item will be exposed to the cooking operation for a time period that exceeds optimal cooking conditions. In most cases, the food item will become inedible due to prolonged exposure to high temperature conditions in the oven. In other cases, where the exposure is limited, the overall appearance of the food item might be acceptable, but the quality and taste will be less than desirable.

Based on the above, there exists a need for a cooking appliance that requires both temperature and time parameter inputs before initiating a cooking operation. More specifically, there exists a need for a cooking appliance that operates in a first mode, wherein both temperature and time inputs are required for a cooking operation, and in a second mode, wherein a consumer can choose to remove the time requirement.

SUMMARY OF THE INVENTION

The present invention is directed to a control system for a cooking appliance that operates in a first mode requiring both temperature and time input parameters before initiating a cooking operation, and in a second mode, enabling a consumer to selectively obviate the time parameter requirement before initiating the cooking operation. In general, the invention requires that the consumer enter both a cook temperature parameter and a cook time parameter unless the consumer consciously chooses otherwise.

In accordance with a preferred form of the invention, once the consumer inputs both temperature and time parameters, the control system will perform a cooking operation at the input temperature and for the selected time parameter. Once the time parameter has been terminated, the cooking operation is considered complete. In accordance with the most preferred form the invention, at the completion of the cooking operation, the control system operates the cooking appliance at a reduced power level so as to maintain the food item in a warm state while, at the same time, preventing the food item from burning.

In further accordance with the most preferred form of the invention, the control system enables the consumer to opt-out of selecting the time parameter. That is, the consumer can select to operate the cooking appliance in the second mode wherein only a temperature parameter is inputted into the control system. In one embodiment, the cooking appliance is provided with a dedicated control element that enables the consumer to toggle between the first or default mode, wherein both time and temperature parameters are required, and the second mode, wherein only a temperature parameter in necessary.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
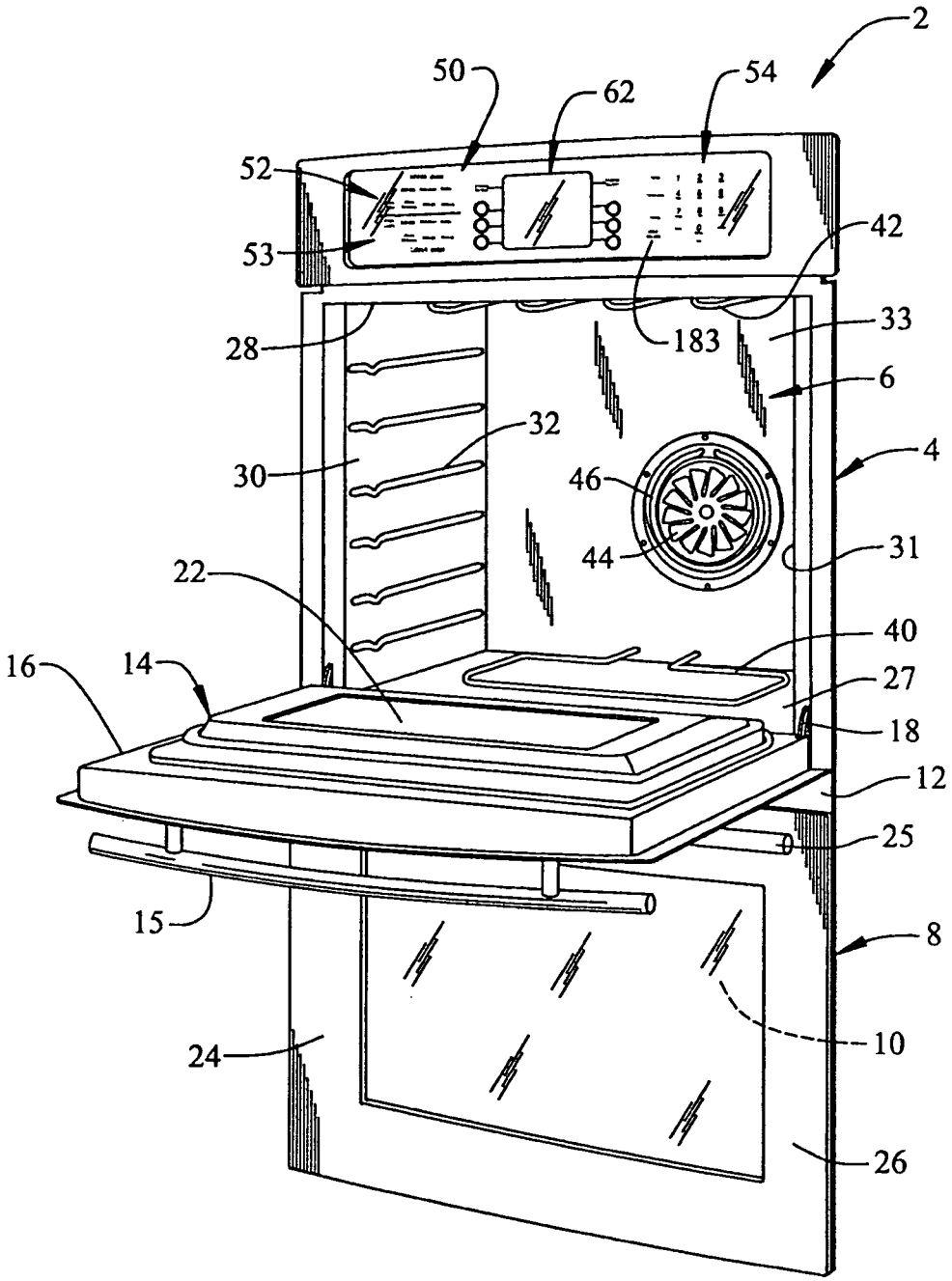
FIG. 1 is a perspective view of a wall oven constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention not limited to this model type and can be incorporated into various types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for supporting both upper and lower oven cavities 6 and 10.

In a manner known in the art, a door assembly 14 is provided to selectively provide access to upper oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. A corresponding door assembly 24 including a handle 25 and a transparent zone or window 26 is provided to selectively access lower oven cavity 10.

As best seen in FIG. 1, oven cavity 6 is defined by a bottom wall 27, an upper wall 28, opposing side walls 30 and 31 provided with a plurality of vertically spaced side rails 32, and a rear wall 33. In the preferred embodiment shown, bottom wall 27 is constituted by a flat, smooth surface designed to improve the cleanability of oven cavity 6. Arranged about bottom wall 27 of oven cavity 6 is a bake element 40. Also, a top broiler element 42 is arranged along upper wall 28 of oven cavity 6. Top broiler element 42 is provided to enable a consumer to perform a grilling process in upper oven 4 and to aid in pyrolytic heating during a self-clean operation. More specifically, both bake element 40 and top broiler element 42 are constituted by sheathed electric resistive heating elements.

Based on the above, in the preferred embodiment depicted, cooking appliance 2 actually constitutes an electric, dual wall oven. However, it is to be understood that cooking appliance 2 could equally operate on gas, either natural or propane. In any case, both oven cavities 6 and 10 preferably employ both radiant and convection heating techniques for cooking food items therein. To this end, rear wall 33 is shown to include a convection fan or blower 44. Although the exact position and construction of fan 44 can readily vary in accordance with the invention, the most preferred form of the invention, fan 44 draws in air at a central intake zone (not separately labeled) and directs the air into oven cavity 6 in a radial outward direction. As also clearly shown in this figure, another sheathed electric heating element 46, which preferably takes the general form of a ring, extends circumferentially about fan 44 in order to heat the radially expelled air flow. At this point, it should be noted that a fan cover, which has not been shown for the sake of clarity of the drawings, extends about fan 44 and heating element 46, preferably with the cover having an associated central inlet and a plurality of outer radial outlet openings.

Figure 2:
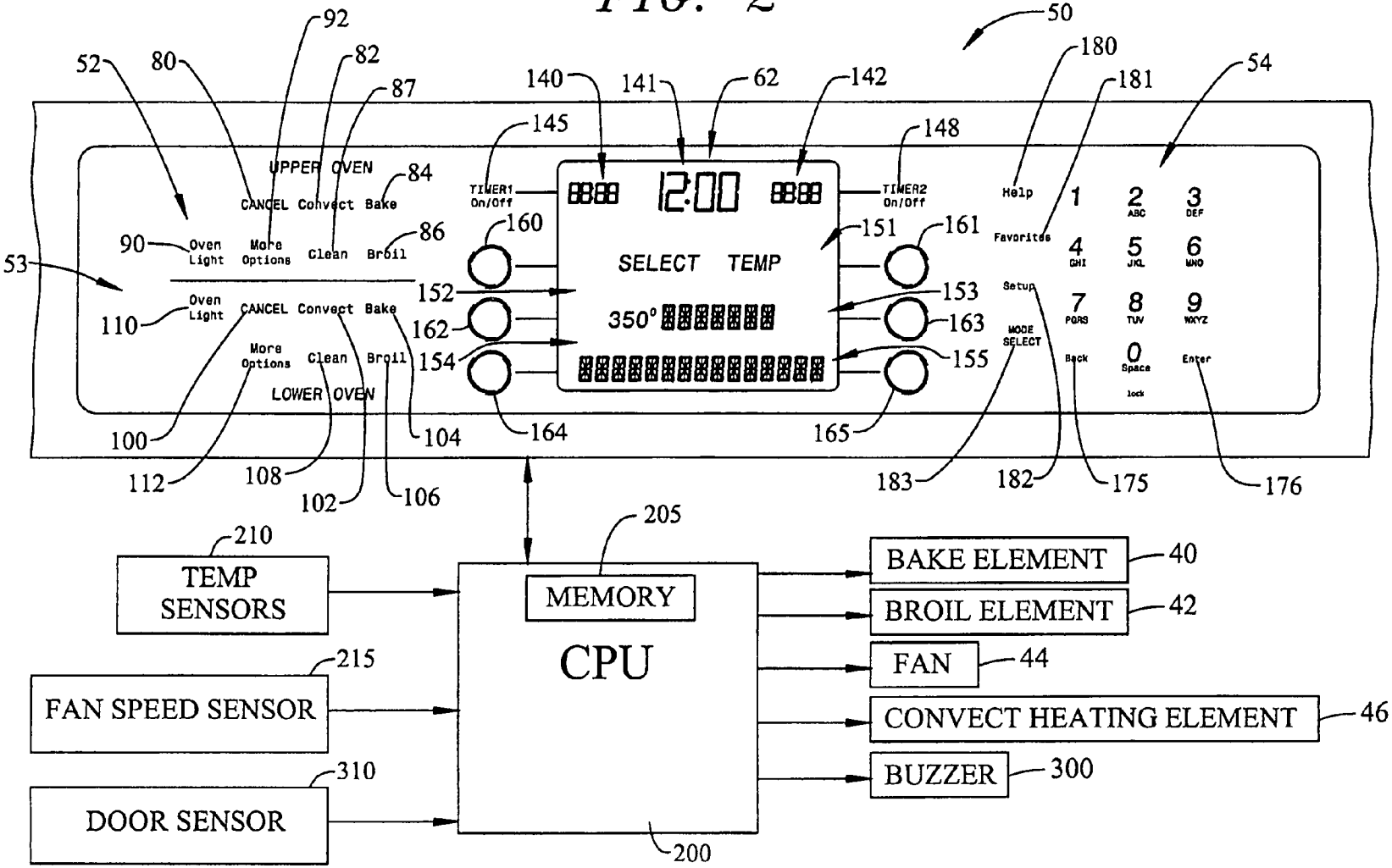
FIG. 2 is an enlarged view of a control panel employed in connection with the wall oven of FIG. 1, illustrating operation in a first mode.

As further shown in FIGS. 1 and 2, cooking appliance 2 includes an upper control panel 50 having a plurality of control elements. In accordance with one embodiment, the control elements are constituted by first and second sets of oven control buttons 52 and 53, as well as a numeric pad 54. Control panel 50 is adapted to be used to input desired cooking parameters and, as will be discussed more fully below, input initial operating conditions for cooking appliance 2. More specifically, the first and second sets of control buttons 52 and 53, in combination with numeric pad 54 and a display 62, enable a user to establish particular cooking operations for upper and lower ovens 4 and 8 respectively.

In the preferred embodiment particularly shown in FIG. 2, first set of control buttons 52 includes a cancel button 80, a convection button 82, a bake button 84, a broil button 86, and a clean button 88. In addition, first set of control buttons 52 also preferably includes an oven light button 90 and a button 92 used to access more cooking options which are conveyed to the user through display 62. In a corresponding manner, second set of control buttons 52 includes a cancel button 100, a convection button 102, a bake button 104, a broil button 106, and a clean button 108. Furthermore, second set of control buttons 53 also preferably includes an oven light button 110 and a button 112 which is used to access more cooking options that are conveyed to the user through display 62.

Display 62 is preferably divided into various sections. In accordance with the most preferred embodiment of the invention, an uppermost section of display 62 is sub-divided into three time display zones 140-142. More specifically, leftmost display zone 140 constitutes a first timer zone having an associated timer button 145. Central display zone 141 constitutes a clock for cooking appliance 2. Rightmost display zone 142 constitutes a second timer zone having an associated timer button 148.

Spaced below time display zones 140-142 are a series of vertically spaced information display zones 151 -155. Each of information display zones 151, 153 and 155 has associated left and right portions (not separately labeled). As shown, each of the left and right portions have associated therewith laterally positioned selection buttons 160-165. As also shown, numeric pad 54 preferably enables alpha-numeric input. That is, in addition to presenting numbers 0-9 , numeric pad 54 doubles as an input source for alpha information. To this end, in a manner somewhat analogous to a telephone keypad, the number 2 button functions for ABC letter entry; the number 3 button functions for DEF letter entry; the number 4 button functions for GHI letter entry; the number 5 button functions for JKL letter entry; the number 6 button functions for MNO letter entry; the number 7 button functions for PQRS letter entry; the number 8 button functions for TUV letter entry; and the number 9 button functions for WXYZ letter entry. The number 0 button can also be used to input a space. On either side of the number 0 button are Back and Enter buttons 175 and 176 which can be used in combination with the various alpha keys for information entry. Finally, provided adjacent numeric pad 54 are Help, Favorites, Setup and mode select buttons 180-183.

In general, control panel 50 is linked to a controller or CPU 200 having a memory module 205, formed as part of an overall control system cooking appliance 2. Therefore, CPU 200 receives user inputs and selections through control panel 50, as well as signals from sensors associated with cooking appliance 2, i.e. oven temperature sensors for upper and lower ovens 4 and 8 as generally indicated at 210 and a fan speed sensor 215. In turn, CPU 200 controls bake element 40, top broiler element 42, convection fan 44 and/or convection heating element 46 for upper oven cavity 6. Of course, a corresponding control is performed for lower oven cavity 10.

Since the general operational characteristics of cooking appliance 2 do not form part of the present invention, these features will not be discussed further here. Instead, the present invention is particularly directed to programming the control system to perform a desired cooking operation in cooking appliance 2.

Figure 3:
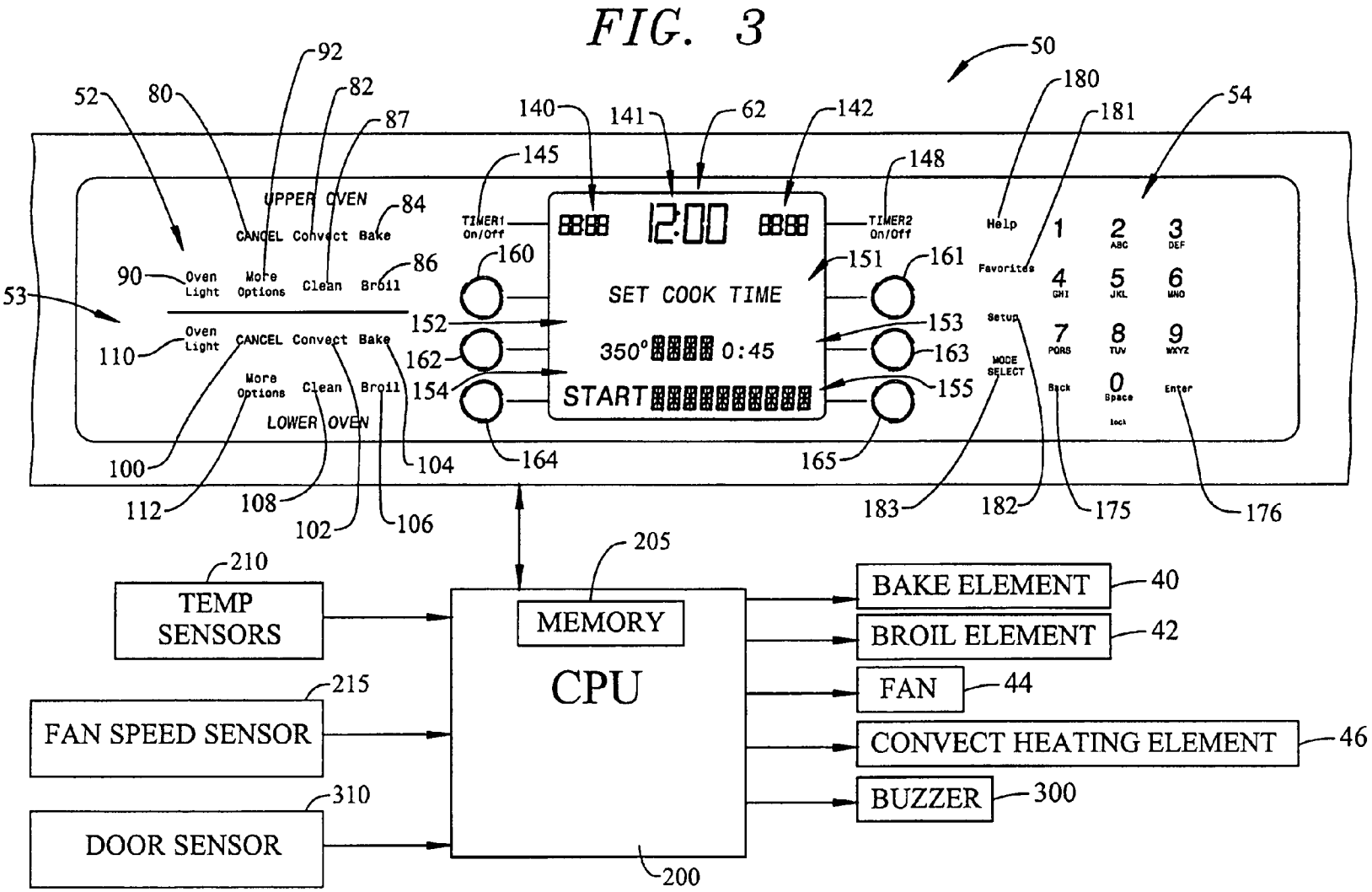
FIG. 3 is an enlarged view of a control panel employed in connection with the wall oven of FIG. 2, further illustrating operation in the first mode in accordance with a second embodiment of the present invention.
Figure 4:
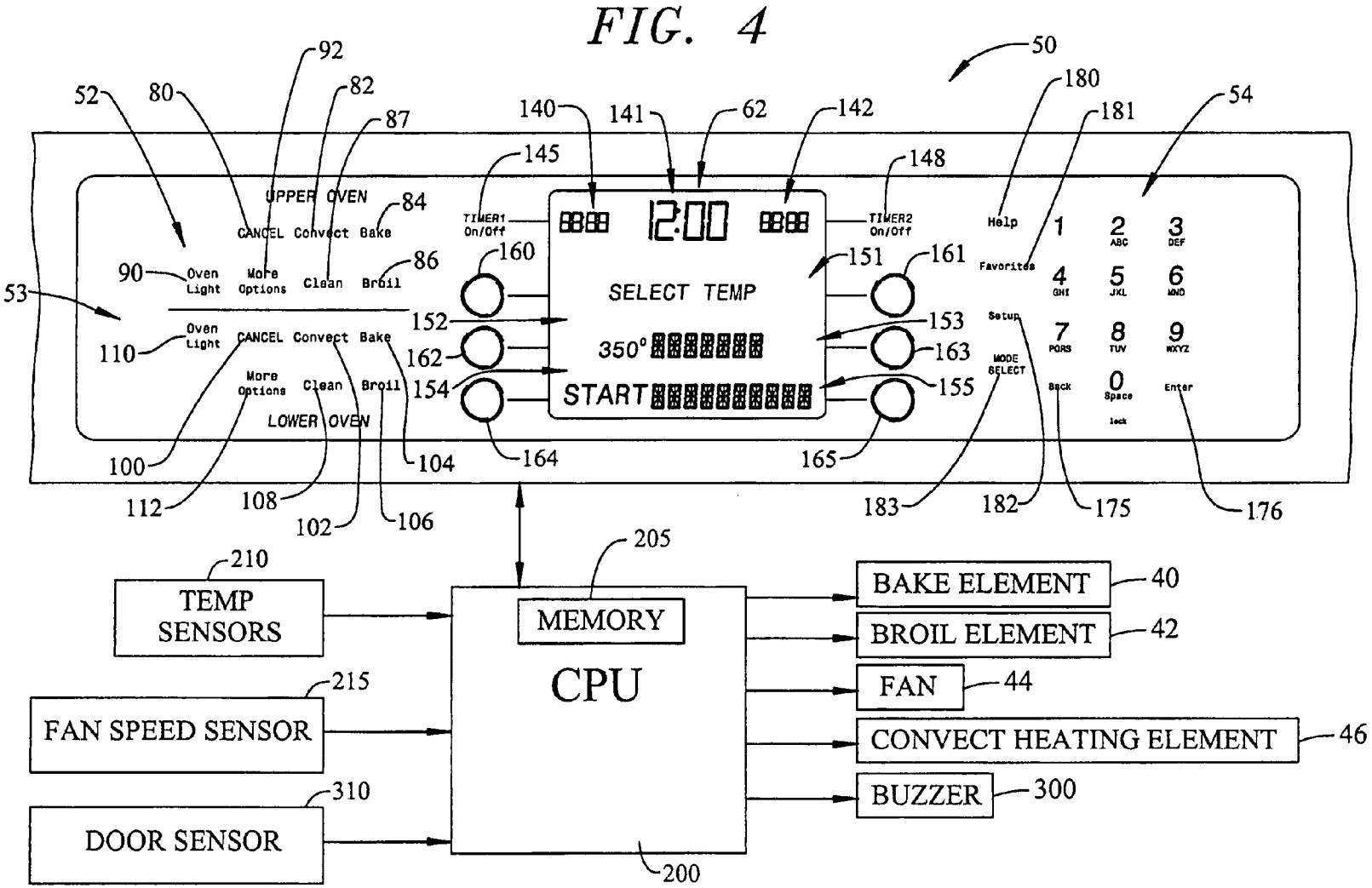
FIG. 4 is an enlarged view of a control panel employed in connection with the wall oven of FIG. 3, illustrating operation in a second mode in accordance with the present invention.

In accordance with the most preferred form of the present invention, cooking appliance 2 is operable in a first or default mode, as well as a second or simplified mode. In the default mode, in order to initiate a cooking operation, a consumer must first select a particular cooking operation, e.g., a convection operation through control button 82 or a bake operation through control button 84. After setting the particular cooking operation, the consumer is prompted, through display 62, to select a temperature parameter for the cooking operation. At this point, the consumer must input a particular temperature through, for example, key pad 54. After the temperature parameter is selected and entered through button 176, display 62 prompts the consumer to set a cook time, as represented in FIG. 3. In a manner similar to that described above, the consumer then must input a cook time or duration through key pad 54. When operating in the default mode, the cooking operation cannot start unless both time and temperature parameters are programmed into CPU 200. After setting the cook time, the consumer once again activates button 176 to set the time parameter. Once both the temperature parameter and the time parameter have been inputted into CPU 200, the consumer may initiate the cooking operation. That is, once both the temperature and time parameters have been established, the consumer may press button 164 to start the cooking operation.

In a manner known in the art, once the consumer initiates the cooking operation, CPU 200 starts a pre-heat cycle within oven cavity 6. During the pre-heat cycle, at least one of the heating elements 40, 42 and 46 is operated to bring the oven cavity up to the selected temperature parameter. After oven cavity 6 has reached the selected temperature, as sensed through temperature sensors 210, a signal is provided to the consumer such as, for example, by activating a buzzer 300, indicating that the pre-heat cycle has completed. At this point, the consumer can open door 14 to insert a food item into upper oven cavity 6. In accordance with the invention, as door 14 is opened, a door sensor 310 is triggered. Once door 14 is closed, again trigging door sensor 310, timer 140 begins to count down the selected cook time. In other words, the cook time selected by the consumer does not begin to run until the food item is inserted into oven cavity 6 as detected through the opening and closing of door 14. Thereafter, timer 140 continues to count down until the selected time parameter has completed. At the completion of the selected time parameter, the consumer may then withdraw the food item from oven cavity 6, in which case door sensor 310 will signal CPU 200 that the food item has been withdrawn and thereafter terminate the cooking operation. Alternatively, the consumer may choose to leave the food item within oven cavity 6 for an extended time period.

In accordance with one aspect of the most preferred form of present invention, if the consumer chooses to leave the food item within oven cavity 6 after completion of the cooking operation, CPU 200 will automatically enter a keep warm cycle. That is, CPU 200 will operate at least one of heating elements 40, 42 and 46 at a reduced power level to maintain a temperature of the food item at a preset warming level. In this manner, the food item will remain warm while, at the same time, preventing the food item from becoming burned due to prolonged exposure at the higher cooking temperature. The keep warm cycle will remain activated for a predetermined time period, for example two hours, or until the consumer removes the food item from oven cavity 6 triggering door sensor 310.

In accordance with another aspect of the most preferred form of the present invention, the consumer may opt to perform a cooking operation in the second or simplified mode. In the event the consumer would like to perform a cooking operation without requiring a time parameter, the consumer can choose to bypass the time requirement by initially depressing mode select button 183. After depressing mode select button 183, the consumer can then input a particular cooking operation through button 82, 84 and/or 86. Display 62 will then prompt the consumer to select a cooking temperature. In a manner similar to that described above, the consumer can program a particular temperature parameter into CPU 200 through key pad 54. Once the temperature parameter has been programmed, activation of key 176 enables the consumer to start the cooking operation. Again, in a manner similar to that described above, the consumer can start the cooking operation by selecting button 164 which will start the pre-heat cycle.

In accordance with a still further aspect of the preferred embodiment, after setting the particular temperature, the consumer can, if desired, select more options button 92 to input the type of food being placed in oven cavity 6. CPU 200 will determine a default cook time based upon the selected cook temperature and the type of food item placed in upper oven cavity 6. For instance, although not shown in the figures, display 62 can be provided with options concerning various meats (e.g. beef, poultry, fish), vegetables, starches, pasta or the like for selection by the user through one of buttons 160-165. In any event, the cooking operation starts with the pre-heat cycle and then carries through until the time parameter, established by CPU 200 has terminated. In a manner similar to that described above, the consumer is then presented with the option of leaving the food item within oven cavity 6 for the duration of the keep warm cycle or removing the food item from the oven for an extended time period.

Based on the above, it should be understood that the particular operation of cooking appliance 2 forces the consumer to select both temperature and time parameters for a cooking operation unless the consumer consciously chooses otherwise. In either case, a food item placed within oven cavity 6 will undergo the cooking operation for the selected time period after which the oven is operated at a reduced heating level. The food item is cooked to the proper degree and thereafter maintained at a warm temperature level without being burned in the event that the consumer forgets and/or is unable to remove the food item from the oven cavity immediately upon the completion of the selected cook time.

Although described with reference to a preferred embodiment of the present invention, it should be readily apparent to one of ordinary skill in the art that various changes and/or modifications can be made to the invention without departing from the spirit thereof. For instance, while described with reference to an electric oven, it should be recognized that the present invention is equally applicable to gas heat, both natural and propane. In addition, it should be understood that the particular programming system described is but one example. Other examples could include inputting time before temperature, operating from a cold start and cooking without a time parameter in the second mode. In general, the invention is only intended to be limited to the scope of the following claims.

I claim:

1. A cooking appliance comprising:

an oven cavity;

at least one heating element positioned to direct heat into the oven cavity;

a door mounted for movement relative to the oven cavity for selectively closing the oven cavity;

a control panel including a plurality of input members for programming at least time and temperature parameters for a cooking operation in the oven cavity, a mode selector input member, and means for selecting the cooking operation to be performed in the oven cavity from various distinct cooking operations including convection, bake and broil cooking options; and means for controlling said at least one heating element in:

a default mode, entered without using the mode selector input member, wherein the controlling means requires both time and temperature parameters to be input through the control panel in order to initiate the cooking operation; and a bypass mode, entered via the mode selector input member, wherein the controlling means requires only a temperature parameter to be input through the control panel in order to initiate the cooking operation, wherein, in both the default and bypass modes, the controlling means only initiates the cooking operation after a cooking operation selection is made through the selecting means.

2. The cooking appliance according to claim 1, further comprising:

a timer adapted to count down a time remaining for the time parameter; and a door switch adapted to initiate operation of the timer, wherein said timer automatically begins, without any additional user intervention, after the door switch detects that the door has been opened and then closed.

3. The cooking appliance according to claim 1, wherein the controlling means operates a bake element or a convection heating element in a reduced, warming power level upon completion of the time parameter.

4. The cooking appliance according to claim 3, wherein the controlling means operates a bake element or a convection heating element at the reduced power level for a defined period so as to prevent a food item from becoming burned.

5. In a cooking appliance including an oven cavity, at least one heating element disposed inside said oven cavity, and a control panel having a plurality of input members for programming at least time and temperature parameters for a cooking operation into a control system, a method of performing the cooking operation comprising:

a) selecting the cooking operation to be performed in the oven cavity from various distinct cooking operations, including convection, bake and broil cooking options, wherein the cooking operation can only be initiated after a cooking operation selection is made;

b) operating the cooking appliance in a default mode, entered without using a mode selector input member, by:

selecting a temperature parameter for the cooking operation through the control panel;

inputting a time parameter through the control panel, said time parameter establishing a duration for the cooking operation; and initiating the cooking operation in the default mode after both the temperature parameter and time parameter have been input to the control system; and c) operating the cooking appliance in a bypass mode by:

activating the mode selector input member to bypass the default mode wherein, upon bypassing the default mode, input of a time parameter is not required and the control system can perform the cooking operating based only on a temperature parameter;

inputting a temperature parameter for the cooking operation through the control panel; and initiating the cooking operation in the bypass mode after the temperature parameter has been input.

6. The method of claim 5, further comprising: automatically operating a bake element or a convection heating element at a reduced power level at a termination of the time parameter.

7. The method of claim 5, wherein the control system performs a preheat cycle if the input member for bypassing the time requirement is selected.

8. The method of claim 5, further comprising: initiating a timer to automatically begin counting down the time parameter, without any additional user input upon sensing a door opening followed by a door closing.

* * * * *